US005848516A

United States Patent [19]

Ban

[11] Patent Number: 5,848,516

[45] **Date of Patent: *Dec. 15, 1998**

[54] METHOD OF MANUFACTURING A TONER BOTTLE

[75] Inventor: Yutaka Ban, Tokyo, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 526,313

[22] Filed: Sep. 11, 1995

[30] Foreign Application Priority Data

Sep. 12, 1994 [JP] Japan ..... 6-217284

[51] Int. Cl.[6] ..... B65B 47/00; G03G 15/08

[52] U.S. Cl. ..... 53/453; 53/423; 53/561

[58] Field of Search ..... 53/452, 423, 453, 53/561, 559, 122, 113

[56] References Cited

U.S. PATENT DOCUMENTS

| | | | |
|---|---|---|---|
| 3,325,860 | 6/1967 | Hansen | 53/561 |
| 3,325,862 | 6/1967 | Mehnert | 53/561 |
| 3,785,116 | 1/1974 | Munz et al. | 53/561 |
| 4,040,233 | 8/1977 | Valyi | 53/561 X |
| 4,584,823 | 4/1986 | Nagel | 53/561 X |
| 4,981,218 | 1/1991 | Ban et al. | 206/633 |
| 5,089,854 | 2/1992 | Kaieda et al. | 355/260 |
| 5,178,816 | 1/1993 | Suzuki et al. | 264/530 |
| 5,268,722 | 12/1993 | Ikkatai et al. | 355/260 |
| 5,351,728 | 10/1994 | Ban et al. | 141/364 |

FOREIGN PATENT DOCUMENTS

| | | |
|---|---|---|
| 1397037 | 8/1965 | France . |
| 1-183677 | 7/1989 | Japan . |
| 4-52763 | 5/1992 | Japan . |
| 5-341647 | 12/1993 | Japan . |
| 108976 | 10/1990 | Rep. of Korea . |

OTHER PUBLICATIONS

Patent Abstracts of Japan, vol. 18, No. 178 (p–1717), Mar. 25, 1994, relating to JP 5–341647, published Dec. 24, 1993.

Patent Abstracts of Japan, vol. 13, No. 467 (p–948), Oct. 23, 1989, relating to JP 1–183677, published Jul. 21, 1989.

*Primary Examiner*—James F. Coan

*Attorney, Agent, or Firm*—Fitzpatrick, Cella, Harper & Scinto

[57] ABSTRACT

A toner bottle for containing powder toner includes a toner supply opening at one longitudinal end; lateral recesses or projections extending in a direction crossing with a longitudinal direction of the bottle; and a plurality of longitudinal recesses or projections extending substantially in the longitudinal direction in both sides of the lateral recesses or projections.

7 Claims, 9 Drawing Sheets

METHOD OF MANUFACTURING A TONER BOTTLE

FIELD OF THE INVENTION AND RELATED ART

The present invention relates to a toner bottle and a toner bottle manufacturing method for supplying powdery developer to an image forming apparatus such as a dry type electrophotographic copying machine or printer.

In an image forming apparatus such as an electrophotographic copying machine or laser beam printer, a photosensitive drum uniformly charged is selectively exposed to light to form a latent image, which is visualized by toner, and the toner image is transferred onto a recording material such as paper. In such an apparatus, the toner has to be replenished. To accomplish this, a toner bottle having an opening at a longitudinal end thereof is used, particularly, a toner bottle having a relatively large capacity not less than 1000 $cm^3$ is preferably used. The toner bottle contains a predetermined amount of toner, and is sealed by capping, and is sent to a user. When the cap is mounted to the bottle, the bottle has a male screw portion, and the cap has a female, screw portion. The toner is generally powdery containing particles having a volume average particle size of 20 $\mu$m or smaller. In order to avoid leakage of the toner between the bottle and the cap due to vibration, falling impact, temperature variation, humidity variation, pressure variation or the like during transportation, a gasket of rubber or elastomer is frequently used. The user supplies the toner from the toner bottle in the copying machine, printer or another image forming apparatus main assembly. However, since the toner is powdery, contamination tends to occur. To avoid this, the cap is provided with a rotary shutter, slide shutter or another opening mechanism. The toner bottle is mounted to the main assembly of the image forming apparatus with the cap downward, and then, the opening mechanism is released to permit the toner to fall into the main assembly. At this time, the cap of the toner bottle and the toner receptor opening of the image forming apparatus are coupled to be in a sealed state to prevent leakage or scattering of the toner during toner replenishment. On the other hand, the toner has a tendency of bridging, particularly, the toner tends to plug a throat adjacent the shutter mechanism or adjacent inclined portions of the bottle. In such a case, the user may strongly press the toner bottle to forcibly discharge the toner with the result that a large amount of air and a large amount of toner are abruptly fed with the possible result of blowing of the toner between the cap and the toner receptor opening. Therefore, the toner bottle is required to have such a rigidity that it does not deform even if pressed by the operator's hands.

In order to prevent toner plugging, it has been proposed in Japanese Laid-Open Utility Model Publication 52763/1992 that a plurality of projections are extended on the inside of the bottle in a direction crossing with the longitudinal direction to loosen the toner. The projections function also to increase the rigidity of the bottle.

The toner bottle has been produced by a direct blowing method, usually. Because of the limitation from the manufacturing method and the requirement for the rigidity of the toner bottle, the thickness of the bottle is relatively large, and the minimum thickness is usually 1.0–3.0 mm approx.

In the case of the direct blowing method, the product is taken out of the metal mold, and the parison at the opening and the bottom is removed. Then, usually the finishing process has been carried out to improve the surface property of the surface to which the gasket is contacted to assure the sealing property.

When the cap is provided with a rotary shutter, the cap and the bottle have to be rotated to close or open the shutter when the toner bottle is mounted on the image forming apparatus. To facilitate this operation, the cap may be provided with a lever or handle. When the cap is provided with such a projection, the angular position of the cap has to be within a predetermined range to permit contact packaging of the toner bottle. To accomplish this, the dimensional accuracy is required in the screw at the end of the bottle and the longitudinal dimension thereof. In this case, the finishing process for the end surface of the opening is particularly important.

In the case that the cap is provided with the rotary shutter, and the shutter is opened and closed by rotating the cap, it is preferable that a stopper mechanism is provided to prevent rotation, thus preventing loosening of the cap. To accomplish this, stopper projections are provided adjacent the opening of the toner bottle and adjacent the toner bottle side end of the cap thus the rotation is prevented by abutment therebetween.

However, the prior art toner bottles have the following problems.

The increase of the plastic material waste is a social problem, so that the demand for the reduction of the amount of the used material (source reduction) is strong. However, as contrasted to the bottles for drinks, the toner blowing or breakage during transportation may occur, if the thickness is simply reduced.

In the case of direct blowing method, the parison removal or the end finishing is required with the result of an increase of the manufacturing cost. Additionally, the positional accuracies such as the distance from the end of the opening to the screw and the surface property of the end surface of the opening, tend to vary, with the result of toner leakage or improper angular position of the cap.

When a projection is provided to prevent the rotation of the cap adjacent the bottom screw, the thickness is smaller at the corner or the like of the projection, which may lead to pin holes. This is particularly remarkable when polypropylene resin is used, because it does not exhibit a self curing property.

When the above-described projections or a male screw is provided adjacent the opening of the bottle, and this is produced by the direct blowing method, the inside surface corresponding to the projection or screw is concave (FIG. 11) with the result of easy stagnation of the toner upon the toner replenishing operation. The recess may initiate toner bridging with the result of tendency of plugging with the toner. Additionally, the stagnation of the toner in the recess may increase the remaining amount of the toner, which may scatter.

In order to increase the rigidity, the minimum thickness is 1.5 mm, but the transparency of the material is still low even if use is made with random copolymer resin material of polypropylene and polyethylene exhibiting high anti-impact property even at the low temperature.

With the random copolymer, the low temperature anti-shock strength increases with an increase in the ethylene content, but the rigidity and the transparency become poor. In the case of the toner bottle produced by direct blowing method, the ethylene content is at least 3.0% to provide sufficient low temperature falling test. With this content, the copolymer resin exhibits low rigidity, and therefore, the thickness cannot be decreased, and therefore, the transparency improvement is difficult.

SUMMARY OF THE INVENTION

Accordingly, it is a principal object of the present invention to provide a toner bottle and a toner bottle manufacturing method.

It is another object of the present invention to provide a toner bottle having a high rigidity and a method of manufacturing the same.

It is a further object of the present invention to provide a toner bottle having a high mounting accuracy of a cap, and a manufacturing method therefor.

According to an aspect of the present invention, there is provided a toner bottle for containing powder toner, comprising: a toner supply opening at one longitudinal end; lateral recesses or projections extending in a direction crossing with a longitudinal direction of the bottle; and a plurality of longitudinal recesses or projections extending substantially in the longitudinal direction in both sides of the lateral recesses or projections.

It is a further object of the present invention to provide a manufacturing method for a toner bottle, comprising the steps of: injection molding a preform; expanding the preform; blowing the expanded preform to form a bottle; supplying powdery toner into the bottle; mounting a cap to close an opening of the bottle.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiment of the present invention will be described in detail.

Figure 1:
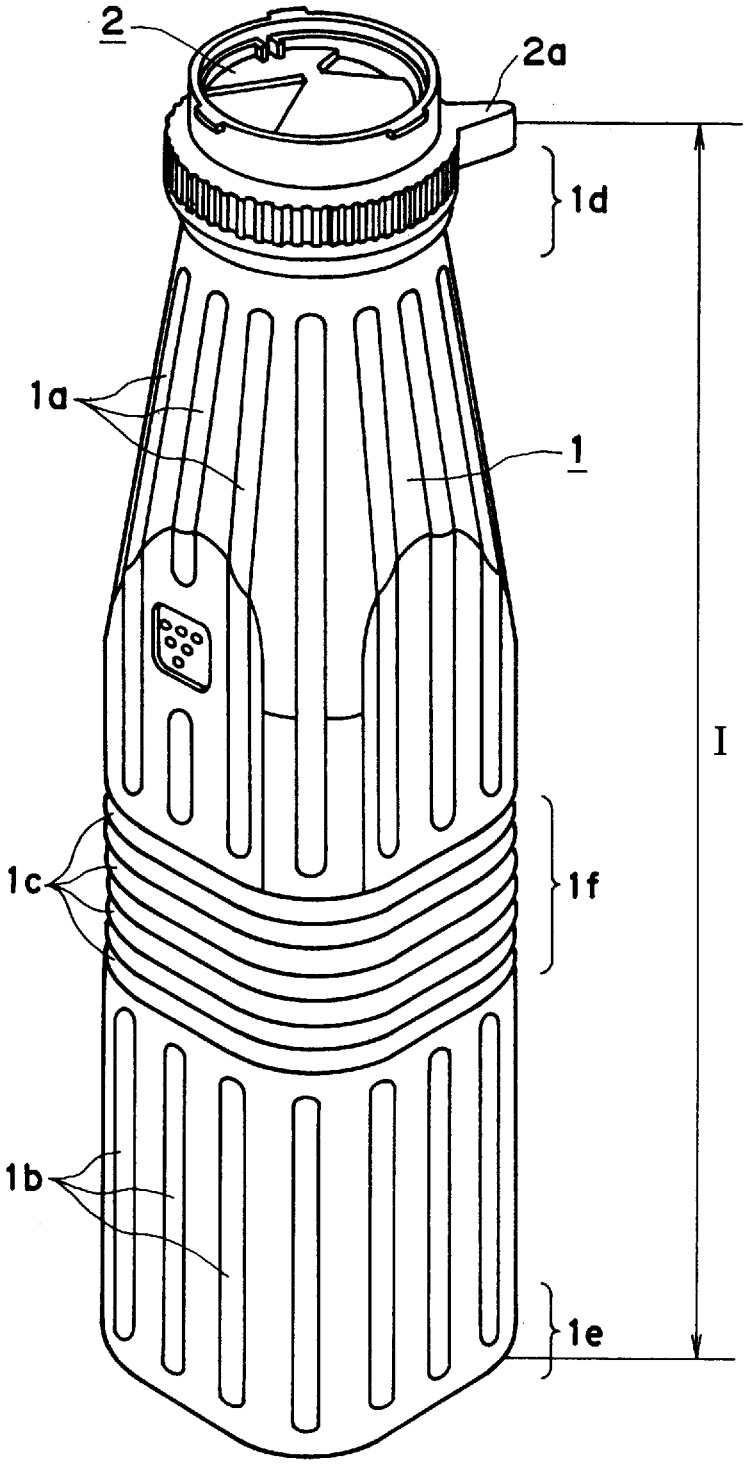
FIG. 1 is a perspective view of a toner bottle according to an embodiment of the present invention.

FIG. 1 is a perspective view of a toner bottle according to an embodiment of the present invention.

Figure 2:
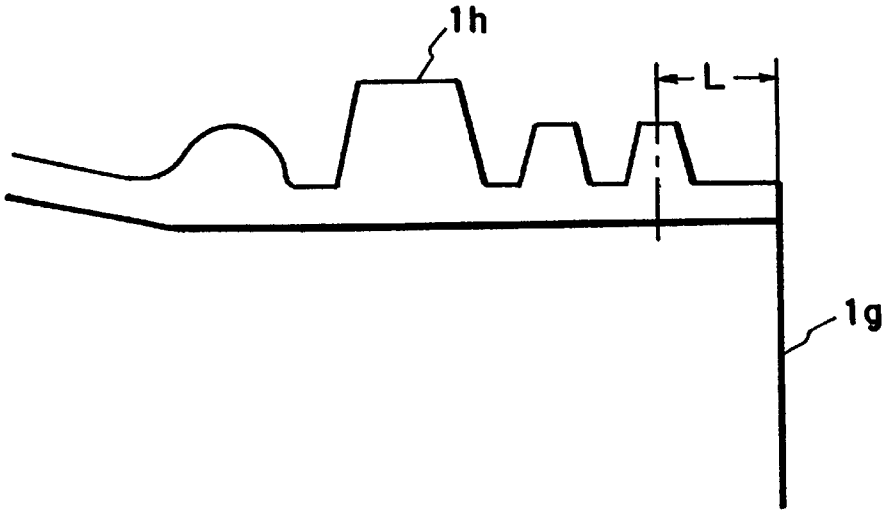
FIG. 2 is a detailed sectional view of a screw portion of a toner bottle according to an embodiment of the present invention.

FIG. 2 is a detailed sectional view of a threaded opening of the toner bottle.

In FIG. 1, reference numeral 1 designates a bottle portion of the toner bottle, 1*a* and 1*b* are groove or ribs extending along the length of the bottle, 1*c* is a grooves or ribs extending in a direction crossing with (perpendicular to, in this embodiment) the length of the bottle, 1*g* is an opening of the toner bottle, 1*e* is a bottom of the bottle at the opposite side of the opening 1*d*, 1*f* is a substantially middle portion of the bottle in the longitudinal direction, 2 is a cap, and 2*a* is a grip or handle in the form of a lever of the cap.

Grooves (recess) 1*a* extend toward the central portion 1*f* of the bottle adjacent to the opening 1*d*. A plurality of grooves are formed at regular intervals. Grooves (recesses) 1*b* extend toward the central portion of the bottle 1*f* adjacent to the bottom 1*e*, and are formed at regular intervals. The grooves (recesses) 1*c* are circumferentially formed substantially at the central portion 1*b* of the bottle.

Preferably, the grooves are uniformly distributed all over the surface of the bottle. Particularly, the grooves 1*a* and 1*b* are close to the opening 1*d* and bottom 1*a* having high rigidity. The circular grooves 1*c* substantially perpendicularly extended to the longitudinal direction, are disposed adjacent the central portion 1*f* of the bottle to efficiently increase the rigidity. The size and the number of the ribs are preferably such that they occupy not less than 10% and not more than 50% of the entire surface area of the bottle. More preferably, it is not less than 20% and not more than 40%, further preferably not less than 25% and not more than 35%. If it is less than 10%, the rigidity increasing effect and the toner loosening effect are not sufficient. If it is more than 50%, it corresponds to reversed groove less than 50%, and therefore, it is not possible to increase the rigidity furthermore. From the standpoint of the balance between the rigidity increase and the toner loosening effect, the above-described range is preferable. In this embodiment, the surface area of the hole bottle is approx. 1841 $cm^2$, and the area of the grooves is approx. 501 $cm^2$, and therefore, they occupy approx. 27%.

The balance between the grooves 1*a* and 1*b* extending in the longitudinal direction and perpendicular circular grooves 1*c*, is preferably such that the former is not less than 50% and not more than 90% of the entire area of the grooves, more particularly, it is not less than 60% and not more than 80%, further preferably not less than 65% and not more than 75%. If the longitudinal grooves exceed 90%, that is, the perpendicular grooves are less than 10%, the toner loosening effect is hardly provided. In addition, the rigidity adjacent the central portion 1*f* is insufficient. This is close to grooves only in one direction, and the resistance against bottle collapse is hardly provided. If the percentage of the longitudinal grooves is less than 50%, the strength of the opening and the bottom are not enjoyed by the central portion of the bottle with the result of easy deformation in the bottle yielding direction. In order to prevent toner blowing even upon the strong pressing of the bottle by hands during the toner supplying operation which will be described hereinafter, the above-described percentages are preferable. In this embodiment, the area of the ribs 1*a* and 1*b* extending in the longitudinal direction is approx. 336 $cm^2$, and the area of the circular ribs 1*c* is approx. 165 $cm^2$ (approx. 67%).

Figure 3A:
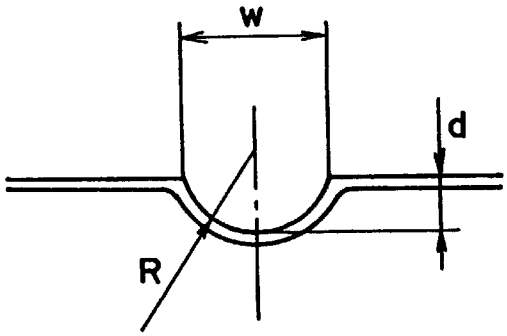
FIGS. 3(*a*) to 3(*c*) are a sectional views showing details of a rib on the surface of the toner bottle.
Figure 3B:
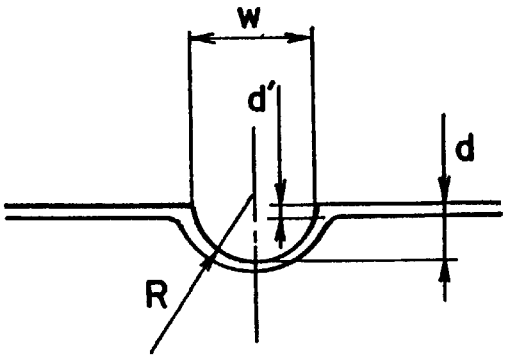
Figure 3C:
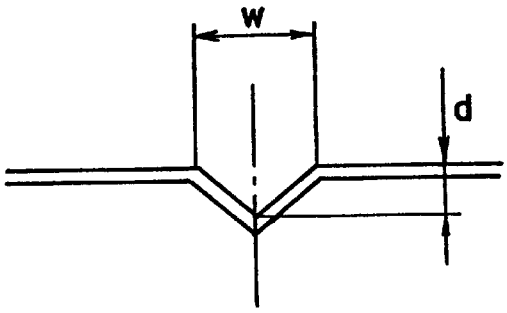

FIGS. 3(*a*) through 3(*c*) are detailed sectional views of grooves or ribs 1*a*, 1*b* and 1*c*. In this embodiment, the cross-section of the grooves or ribs 1*a*, 1*b* and 1*c* have U-shaped arcuate grooves having a width W=8.2 mm and a depth D=3.5 mm as shown in FIG. 3(*d*).

The width of the rib is preferably not less than 3 mm and not more than 20 mm, further preferably not less than 5 mm and not more than 15 mm, most preferably not less than 7 mm and not more than 12 mm. The depth of the ribs is preferably not less than 0.5% and not more than 20% of the distance between inner wall of the container, more preferably not less than 2% and not more than 10%. If the width of the ribs exceeds 20 mm, the rigidity is not transmitted from the bottom end to the bottle central portion, and if it is less than 3 mm, the transfer to the metal mold during the molding operation is difficult. If the depth of the grooves exceeds 20% of the distance between the inner wall, the toner discharge is obstructed. If it is less than 0.5%, the rigidity increase and the toner loosening effect are hardly provided. In this embodiment, the distance between inner wall (inner diameter) is approx. 107 mm and the depth of the groove is approx. 3.3%.

The thickness of the toner bottle 1 of this embodiment is determined as follows. First, adjacent the opening 1*d* not extended by the injection step, it is 2.0 mm, and it is 2.5 mm adjacent the bottom which is not expanded either. In the expanded portion having the grooves 1*a*, 1*b* and 1*c*, it is 0.8–1.1 mm in the average over the circumference at a longitudinal portion, and the minimum is not less than 0.6 mm. The weight of the bottle is 196 g.

As to the relationship between the thickness of the bottle and the rigidity, it is preferable to control the average thickness over the circumference. Even if there is a thin portion, the rigidity may be sufficient if the portion adjacent thereto is thick. There is a high interrelation between the average thickness and the rigidity. The reason is as follows. An injection/stretch/blowing method is used to mold it, substantially uniform thickness is provided in the circumferential direction in the preform of the injection molding. The bottle provided by the blowing method has only local thickness variation, if any. Therefore, a wide thin portion does not result. The thickness of the bottle on the average is not less than 0.6 mm and not more than 3.0 mm, and the minimum thickness is not less than 0.4 mm and not more than 2.5 mm. More preferably, the average thickness is not less than 0.7 mm and not more than 2.0 mm, and the minimum thickness is not less than 0.5 mm and not more than 1.5 mm. Most preferably, the average thickness is not less than 0.8 mm and not more than 1.2 mm, and the minimum thickness is not less than 0.6 mm and not more than 1.0 mm.

This embodiment is particularly usable when the inner volume of toner is not less than 1000 $cm^3$ and not more than 6000 $cm^3$. Even if the bottle having such a small volume of less than 1000 $cm^3$, it does not result in the blowing of the toner even if the bottle is strongly pressed during the supplying operation, because the amount of the air pushed out is not large. Additionally, the rigidity is sufficient in such a small bottle. If the inner volume exceeds 6000 $cm^3$, the operativity is remarkably poor when it is reversely erected to mount to the image forming apparatus. Additionally, the formation using the injection/stretch/blowing method. The volume of the bottle in this embodiment is 3630 $cm^3$. The inner volume of the bottle is measured by filling the bottle with water, and the weight of the water is divided by the specific gravity.

The inner diameter of the toner bottle is preferably not less than 40 mm and not more than 110 mm. If it is less than 40 mm, the discharge of the fine powdery toner will be difficult. If it exceeds 110 mm, the formation by the injection/stretch/blowing method will be difficult. In this embodiment, it is 74.5 mm.

The barrel diameter of the toner bottle is preferably not less than 80 mm and not more than 160 mm. If it is less than 80 mm, the expansion during the blowing step in the radial direction is not sufficient with the result of insufficient anti-impact property with the above-described thickness. If it exceeds 160 mm, the formation by the blowing step becomes difficult. Additionally, the operativity of the bottle is poor, and therefore, it is not practical. In this embodiment, the barrel diameter is 108.5 mm.

The height of the toner bottle is preferably not less than 200 mm and not more than 450 mm. If it is less than 200 mm, the longitudinal expansion in the stretch step is not sufficient, and therefore, no sufficient anti-impact property is provided with the above-described thickness. If the height exceeds 450 mm, the formation by the injection/stretch/blowing method is difficult. Additionally, the operativity is remarkably poor when the bottle is mounted to the image forming apparatus, and therefore, it is not practical. In this embodiment, the height is 420 mm. As to the material of the toner bottle, random copolymer resin of the polypropylene and polyethylene is preferable from the standpoint of the rigidity, transparency, anti-impact property at low temperature and the cost. With the increase of the ethylene content, the anti-impact property increases, but the rigidity and the transparency become poor. In the case of the bottle of this embodiment, the ethylene content is not less than 1.0% and not more than 3.0%. More preferably, it is not less than 1.3% and not more than 2.5%. Most preferably, it is not less than 1.8% and not more than 2.0%. If it exceeds 3%, the rigidity and the transparency are not sufficient even with the above-described groove structure and the thickness. On the other hand, if it is less than 1.0%, the solidification speed is low with the result of the difficulty in the stretching and blowing step. Additionally, anti-impact property is insufficient so that the bottle is broken in the falling test.

The description will be made as to the manufacturing of the toner bottle.

Figures 4A, 4B, 4C:
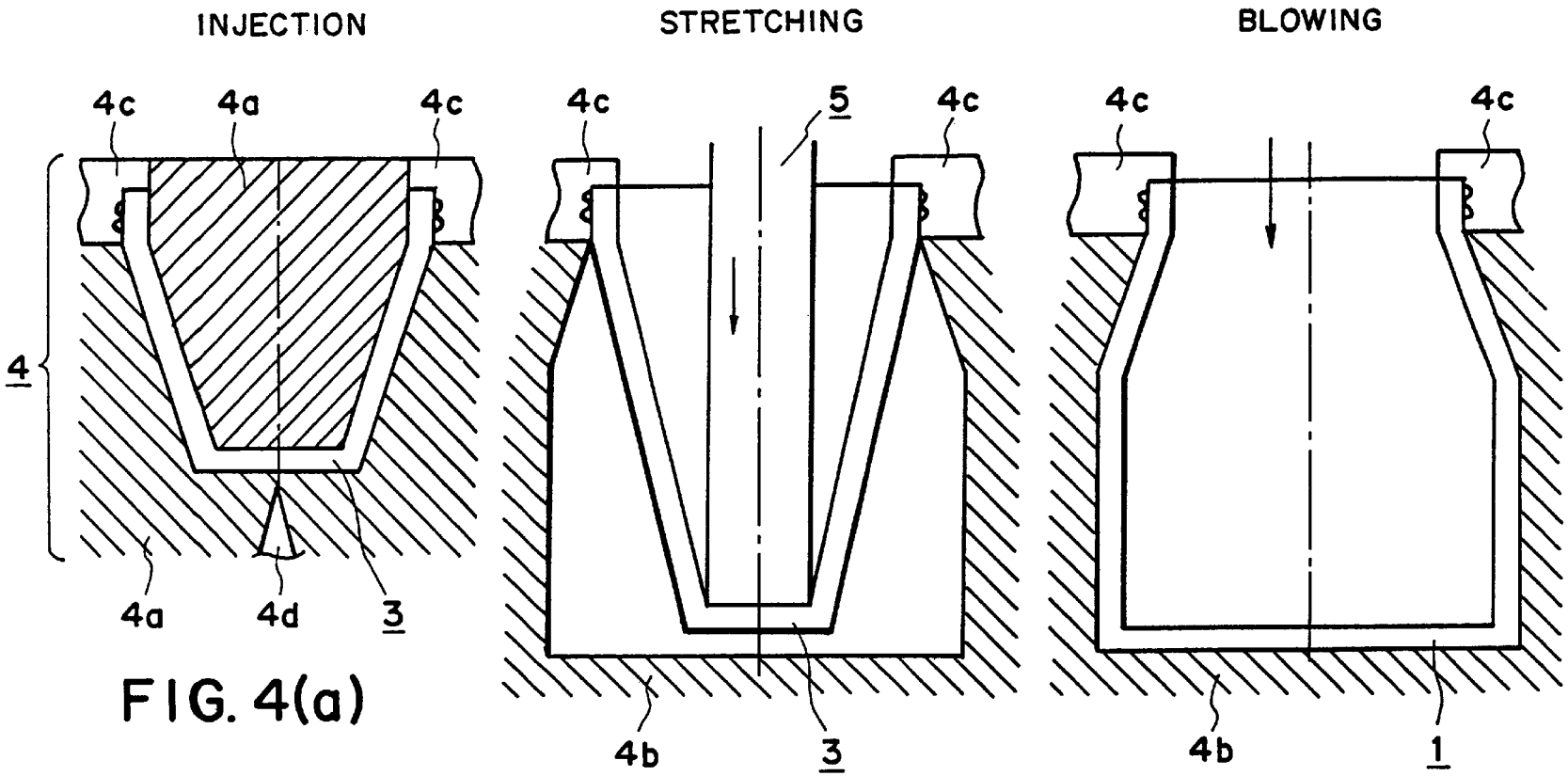
FIGS. 4(*a*) to 4(*c*) are a schematic views illustrating manufacturing steps of a toner bottle according to an embodiment of the present invention.
Figure 5:
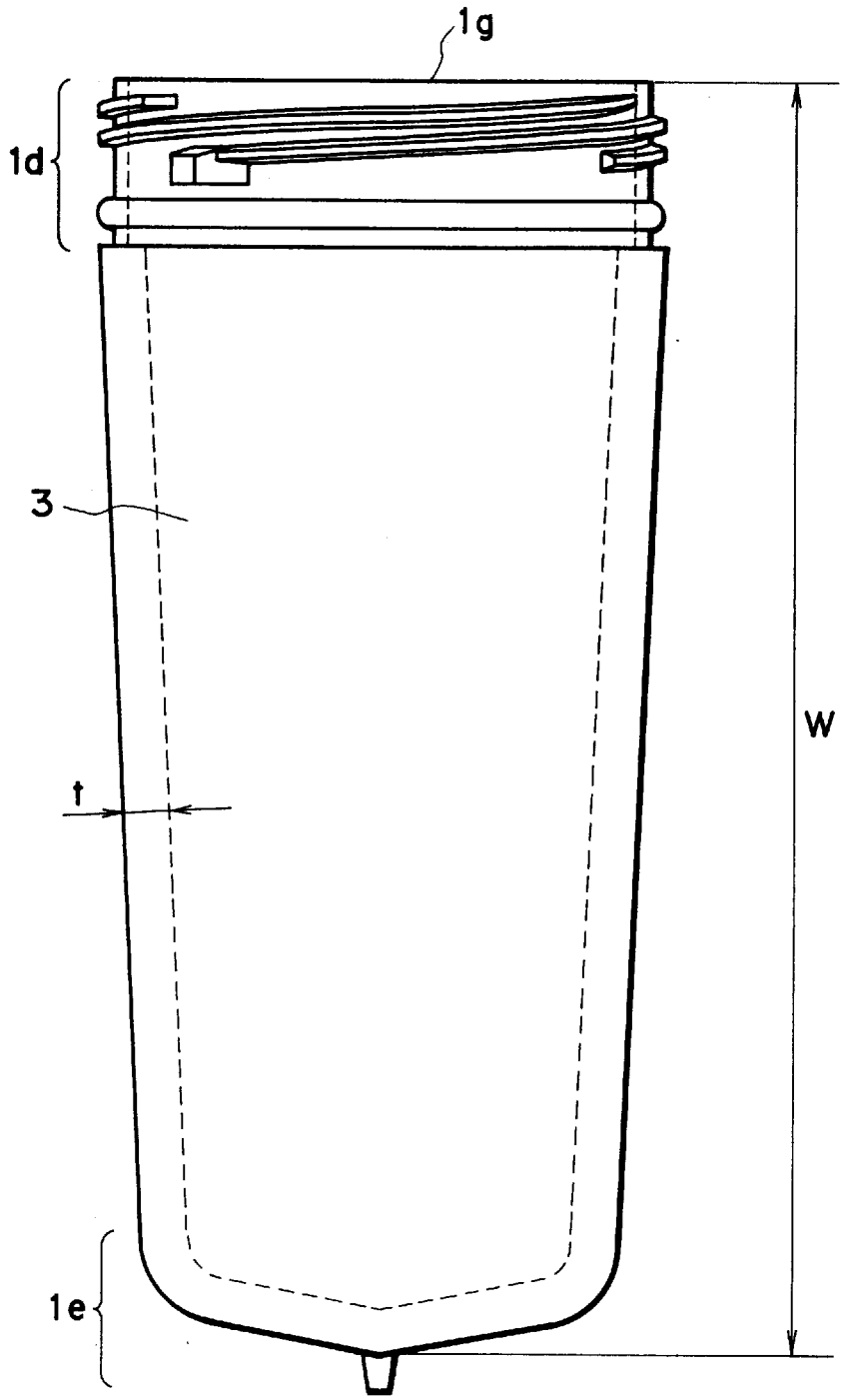
FIG. 5 is front view of preforming produced by injection step in a toner bottle manufacturing method according to an embodiment of the present invention.

FIGS. 4(*a*) through 4(*c*) schematically show the toner bottle manufacturing steps, including an injection step, a stretching step and a blowing step. FIG. 5 is a front view of a preform produced by the injection step. Here, reference numeral 3 designates the preform, 4 is a metal mold, 4*a* is an injection mold, 4*b* is a blowing mold, and 4*c* is a neck metal mold common to all steps, 4*d* is a gate, and 5 is a stretching rod.

In the injection step, resin material is injected into the metal mold through a gate 4*b* from an unshown dispenser in the known injection molding manner. In the next stretching step, the preform 3 is transferred to a blowing metal mold 4*b*, and the preform is expanded in the longitudinal direction by a stretching rod 5. In the blowing step, compressed air is injected into the preform 3 to provide a bottle of a predetermined shape by the blowing mold 4*b* the blowing mold 4*b* is provided with projections extending in the circumferential direction, and a projection extended in the longitudinal direction at the opposite sides of the circumferential projections.

The inner shape of the mold 4*b* is transferred onto the bottle, thus providing the bottle of FIG. 1.

The mold 4*b* is divided into two parts, and are removed in the direction perpendicular to the blowing direction.

The preform 3 has a height h which is lower than the final height H of the bottle. By doing so, the stretch is increased by the expansion. When the material of the bottle is polypropylene resin, the height ratio H/h is not less than 1.2 and not more than 2.5, preferably. If it is less than 1.2, a sufficient anti-impact property is not provided with the above-described thickness. With the increase of the ratio, the anti-impact property is increased, but in the case of the polypropylene resin, it is difficult to expand it to 2.5 times or larger. In this embodiment, the height of the preform is h is 183 mm and a height of the bottle H is 420 mm, and the ratio H/h=2.3.

The thickness t of the preform is properly determined depending on the ratio H/h and the final thickness of the bottle. However, as contrasted to the usual bottle as in a bottle, used for drinks, it has a relatively large thickness, and therefore, t is not less than 5 mm and not more than 10 mm, preferably. In this embodiment, the thickness of the preform is 6.5 mm.

Figure 10:
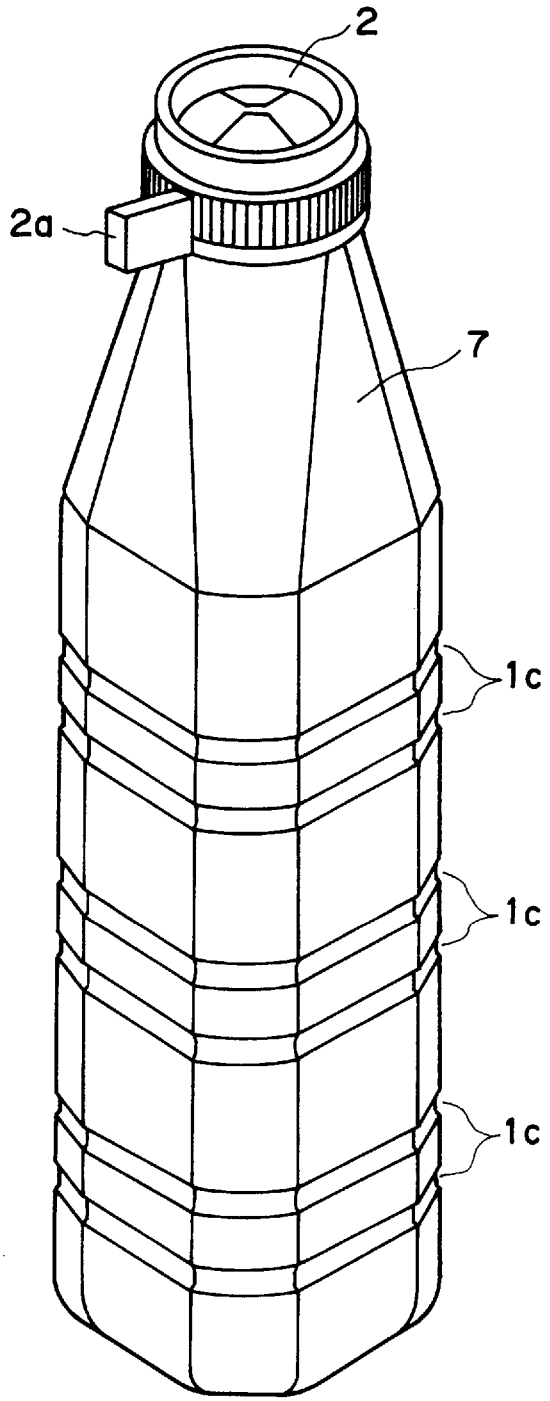
FIG. 10 is a perspective view of a toner bottle according to a comparison example.

The portion 1*d* adjacent the opening and the portion 1*e* adjacent the bottom are neither expanded nor blown, and therefore, the thicknesses thereof is relatively large. Most of the part of the bottle other than those portions are expanded and blown into a small thickness. The weight of the toner bottle of this embodiment is 195 g. The conventional toner bottle having the same volume, as will be described hereinafter, with FIG. 10, is 225 mm, and the reduction of the amount of the material decreases by as large as 13%.

The structure of the cap of the toner bottle will be described.

Figure 6:
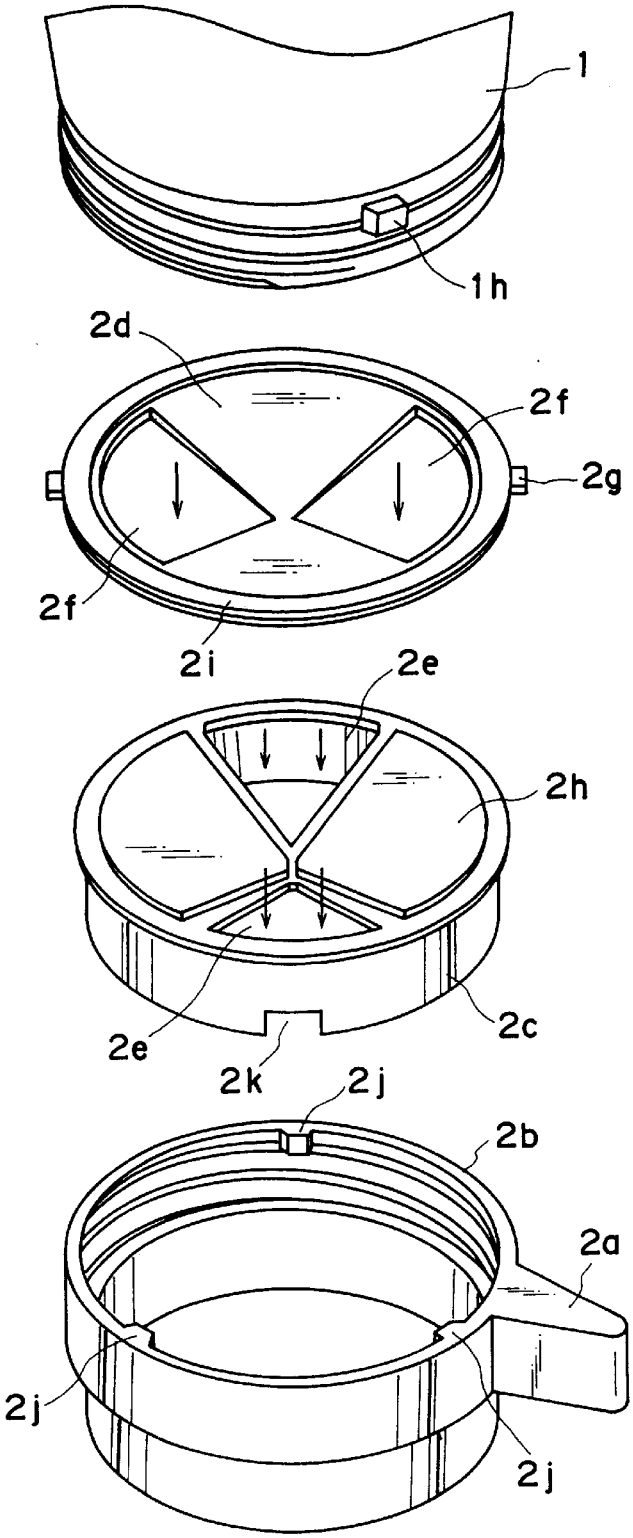
FIG. 6 is an exploded perspective view of a cap according to an embodiment of the present invention.

FIG. 6 is an exploded perspective view of a cap of the toner bottle used in this embodiment. In this Figure, reference 2*a* is a lever, 2*b* is an outer frame of the cap, 2*c* is a rotary shutter, 2*d* is a fixed shutter, 2*e* is a sector opening of a rotary shutter, 2*f* is a sector opening of the fixed shutter, 2*g* is a claw, 2*h* is a sealing member, 2*i* is a gasket.

The fixed shutter 2*d* is fixed to the outer frame 2*b* of the cap by two claws 2*g*. The rotary shutter 2*c* is rotatable relative to the outer frame 2*b* of the cap. They are engaged into the outer frame 2*b* such that the sector openings 2*e* and 2*f* thereof are not aligned.

Between the rotary shutter 2*c* and the fixed shutter 2*d*, a sealing member 2*h* is sandwiched to maintain the sealing. The sealing member 2*h* is required to have the function of maintaining the hermetical sealing and functions to permit smooth closing and opening of the rotary shutter. For this purpose, the material thereof is foamed polyethylene material, foamed polypropylene material, foamed polystyrene, or various rubber sponge, preferably. Most preferably, it is of high density polyurethane foam material. In this embodiment, polyethylene foam having a thickness of *3.0* mm is used.

According to the present invention, even if the area of the toner discharging opening is relatively small as compared with the inside volume of the bottle, the toner can be smoothly discharged. More particularly, the advantage of this embodiment is particularly remarkable when the ratio (W/a) of the area (a) $cm^2$ of the discharging opening and the inside volume (W) of the bottle. In the case of such a small opening, if the bottle is transported or kept without use, that is, with the filled toner, the toner may be caked. If this occurs, it is difficult to smoothly discharge the toner. In this embodiment, the area (a) of the sector openings 2*e* and 2*f* is 10.8 $cm^2$, and the inside volume of the bottom is 3630 $cm^3$ as described hereinbefore, and therefore, ratio (W/a) is 336.

Figure 7:
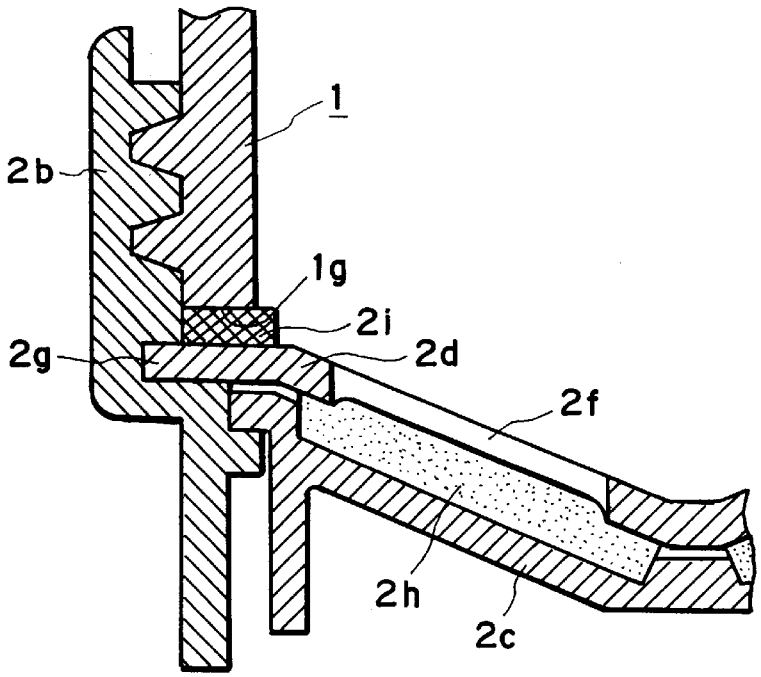
FIG. 7 is a detailed sectional view of a toner bottle on which a cap is mounted.
Figure 8:
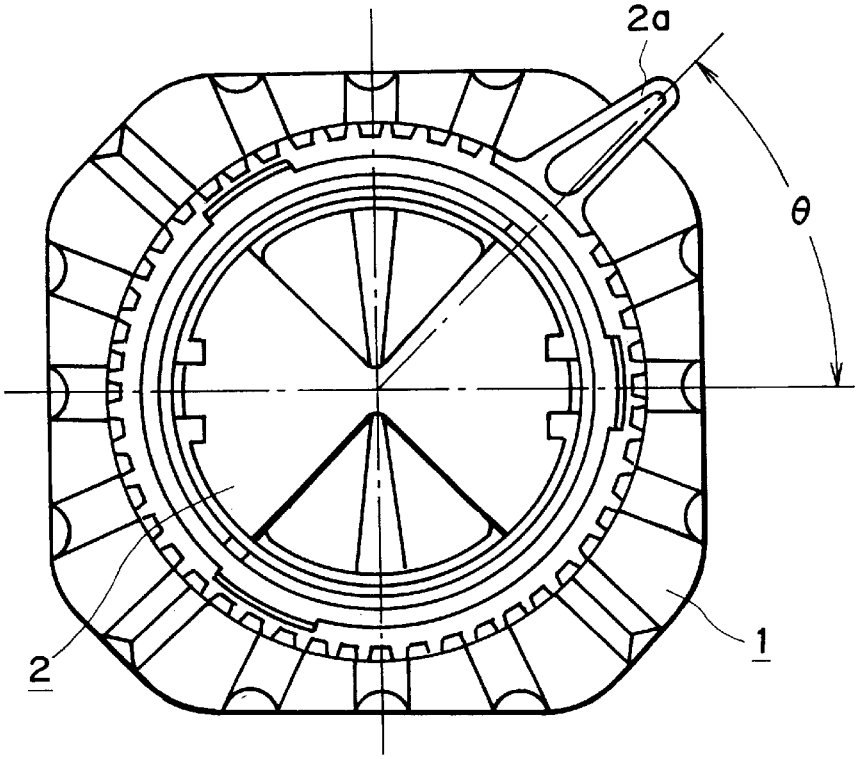
FIG. 8 is a top plan view of a toner bottle to which a cap is mounted.

FIG. 7 is a detailed sectional view in which cap 2 is tightly closed on the bottle 1, and FIG. 8 is a top plan view.

A female screw portion is provided inside the outer frame 2*b*, and is threaded on the male screw portion of the toner bottle. It is preferable to interpose a gasket 2*i* between the opening end surface 1*g* of the bottle and the cap. As a proper material of gasket 2*i*, there is various rubber materials or elastomers of proper hardness. In this embodiment, it is of olefin elastomer having a rubber hardness of 60 degrees and having a thickness of 2.0 mm and has been molded together with the fixed shutter. The rubber hardness is determined by a hardness tester of spring A type as stipulated in JIS-K-6130. Into the toner bottle 1500 g of toner having a volume average particle size of 12 $\mu$m is filled, and the cap is threaded to the toner bottle with a gasket 2*i* therebetween.

In order to maintain a sealing property between the cap 2 and the bottle 1, the surface flatness has to be at a proper level. In this embodiment, the surface roughness of the end surface is 0.25 mm and proper sealing properties have been exhibited in various tests.

Cap 2 is provided with a grip or handle 2*a*. By manipulating it, the rotary shutter 2*c* is opened and closed. On the other hand, the cross-sectional shape of the bottle is substantially square with the corner rounded, as shown in FIG. 8. Therefore, in order to package one bottle with the cap 2 securedly threaded, it is convenient that the handle 2*a* is aligned with a diagonal line of the square. More particularly, the angle of the handle lever 2*a* relative to the bottle 1 ($\theta$ is 45±7 degrees in this embodiment). The screw portion the bottle and the cap are 3-lead screw with the lead of 12 mm, and therefore, the distance L from the bottle end surface to the starting end of the screw is formed within the tolerance of ±0.23 mm. In this embodiment of the toner bottle, the distance L can be within ±0.20 mm. Therefore, the lever 2*a* is within 45±6 degrees. Here, the torque for threading the cap on the bottle is 200 kg.cm.

In this embodiment, a rotary shutter is built in the cap, and the shutter is opened or closed by rotating the cap with the lever 2*a*. It is therefore preferable that a rotation stepper mechanism is provided to prevent loosening of the cap. As shown in FIG. 6, a stopper 1*h* is provided adjacent the opening of the toner bottle, and a stopper 2*j* is provided adjacent the end of the toner bottle inside the outer frame 2*b* of the cap 2. The angular position of the mounting of the stopper projection is such that when the cap is completely threaded on the toner bottle, that is, when the end surface 1*g* of the toner bottle is closedly contacted to the gasket 2*i*, they are engaged.

As shown in FIG. 2, even if the large projection such as the stopper projection is provided, but the backside, that is, the inside of the bottle is smooth. The description will be made as to the process of supplying the toner into the main assembly of the image forming apparatus using the toner bottle described above.

Figure 9:
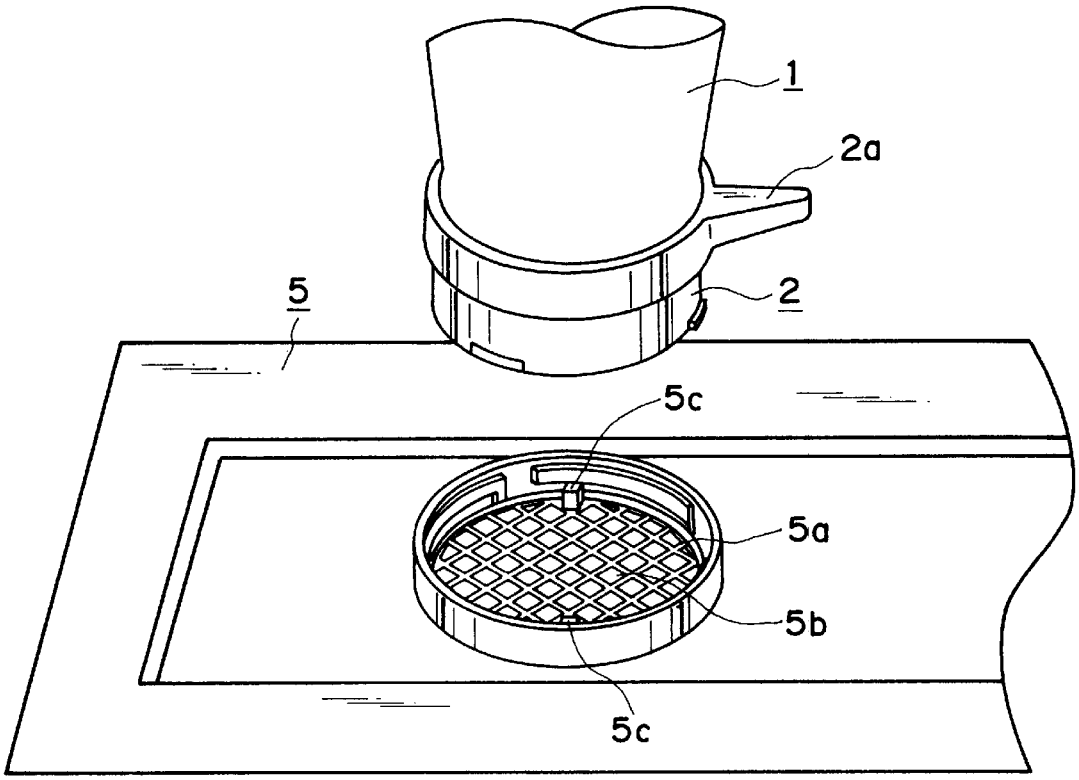
FIG. 9 is a perspective view of a toner bottle which is going to be mounted on a toner receptor of an image forming apparatus.

FIG. 9 is a perspective view in which the toner bottle is going to be mounted to the toner receptor opening of the image forming apparatus, wherein reference numeral 5 designates the main assembly of the image forming apparatus, 5*a* is a toner supply opening, 5*b* is a lattice for preventing foreign matter or the operator's fingers from entering the apparatus, and 5*c* is a projection.

When the toner bottle is transported or simply kept, the toner may be caked due to escape of air by vibration or the like. In consideration of this fact, the toner bottle is vibrated for 10 minutes, and then it is subjected to the test.

Before supplying of the toner, the toner bottle is shaked to cause the toner contain the air. This is done in order to loosen the agglomerated toner to decrease the apparent density of the toner, thus increasing the flowability. When the toner is shaped, the ribs 1*a*, 1*b* and 1*c* projected from the inside surface of the toner bottle are effective to mix the air with the toner particles, thus promoting the loosening or uncaking. From the standpoint of the toner loosing, ribs substantially perpendicular to the longitudinal direction of the bottle contribute than the ribs 1*a* and 1*b* extending longitudinally.

Subsequently, the toner bottle is turned around to orient the cap side downward, and it is mounted on the toner supply opening of the image forming apparatus 5. By doing so, the recess 2*k* of the rotary shutter is engaged with a projection 5*c* of the image forming apparatus. Subsequently, the operator rotates the cap by the handle. The rotary shutter 2*c* is fixed on the image forming apparatus, and the fixed shutter 2*d* is fixed on the outer frame 2*b* of the cap by the flow 2*g*. The above-described rotation rotates it by a predetermined angle. As a result, the sector opening 2*e* of the rotary shutter and the sector opening 2*e* of the fixed shutter are aligned to permit the toner in the toner bottle to fall into the image forming apparatus.

As described in the foregoing, the thickness of the toner bottle is relatively small, and therefore, the motion of the toner particles in the toner bottle during toner supply can be sufficiently observed, so that the completion of toner supply can be observed.

By the shaking the bottle before the supply operation and the auxiliary toner loosening effect of the ribs, the toner contains sufficient air to exhibit high flowability, and therefore, all of the toner in the bottle could be discharged in approx. 20 sec. The inside surface adjacent the opening of the toner bottle is smooth despite the provision of the projection and the male screw on the outer side. The fact is also contributable to the smooth discharging of the toner. The toner remaining in the bottle after the completion is only 1–5 g. No toner bridging (plugging) at the opening of the bottle does not occur.

During the toner supply, that is, when the shutter is opened, the bottle is pressed by hand with strong force, but the bottle has sufficient rigidity with no substantial deformation, and therefore, the toner did not blow out.

After the completion of the toner discharge, the lever is rotated in the opposite direction to close the shutter. Then, the toner bottle is removed from the image forming apparatus. This is the end of the toner replenishing process.

A description will be made as to results of experiments.

The test have been carried out to check whether the toner bottle is durable against falling impact during the transportation or against the variation of the ambient conditions.

For the falling test, a predetermined amount of the toner is filled into the toner bottle, and the toner bottle is packed in a package. An outer package is used to case 8 of such toner bottle packages (all together falling). The samples are left under the condition of −5° C. not less than 12 hours, and then the falling test was carried out. The process of the test was in accordance with JIS-Z-0202. The height was 60 cm. The orientations of the falling was one corner, three edges and 6 surfaces. The sample was let fall 10 times in this order. As a result, in conveniences such as toner bottle break, toner leakage, cap loosening or the like did not occur at all.

The tests were carried out in which the toner bottle was left under a reduced pressure ambience. The toner bottle is filled with a predetermined amount of toner, and the cap is closed. It was left two times under 460 mmHg for 30 min. As a result, the inconveniences such as toner bottle breaking, toner leakage, and cap loosening did not occur.

Also, the test were carried out in which the toner bottle is left under a high temperature and high humidity ambience. The toner bottle is filled with a predetermined amount of toner, and the cap is closed. It is left for 12 hours under 45° C./85%RH. As a result, the inconveniences such as toner bottle breaking, toner leakage, cap loosening or the like did not occur at all.

Comparison Example

Figure 11:
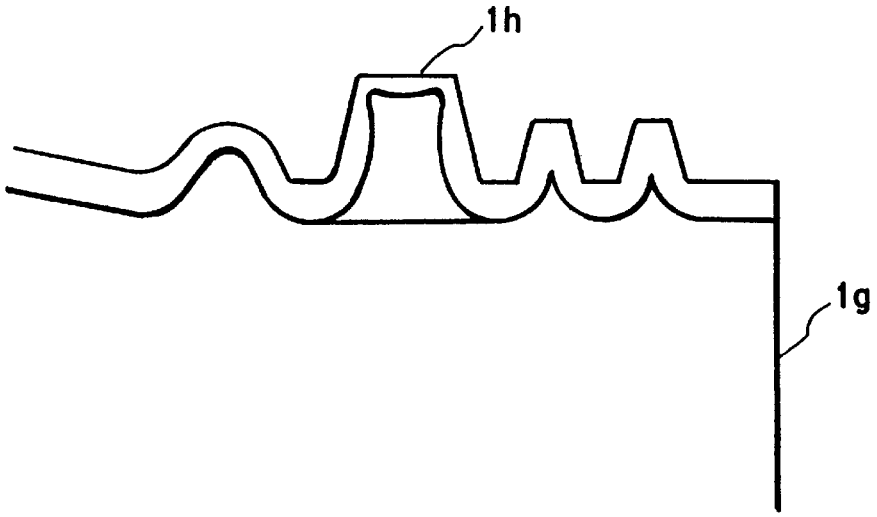
FIG. 11 is a detailed sectional view of a screw of a toner bottle according to a Comparison Example.

FIG. 10 is a perspective view of a toner bottle according to a comparison example. FIG. 11 is a detailed sectional view of the screw portion of the toner bottle of the comparison example.

In this example, the ribs or grooves are extended only in a direction substantially perpendicular to the length of the bottle. The thickness is 1.0 mm or larger. The cross-sectional area of the groove is as shown in FIG. 3, (*a*).

Figure 12A:
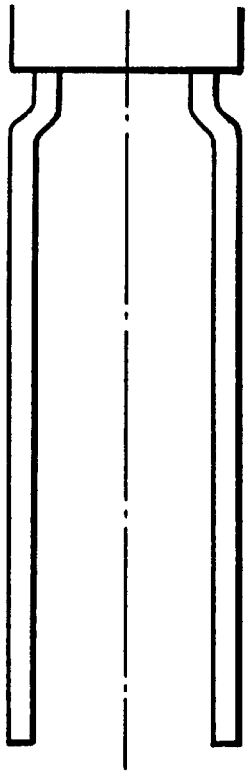
FIGS. 12(*a*) to 12(*b*) are a schematic views illustrating a manufacturing step of a toner bottle according to a comparison example.
Figure 12B:
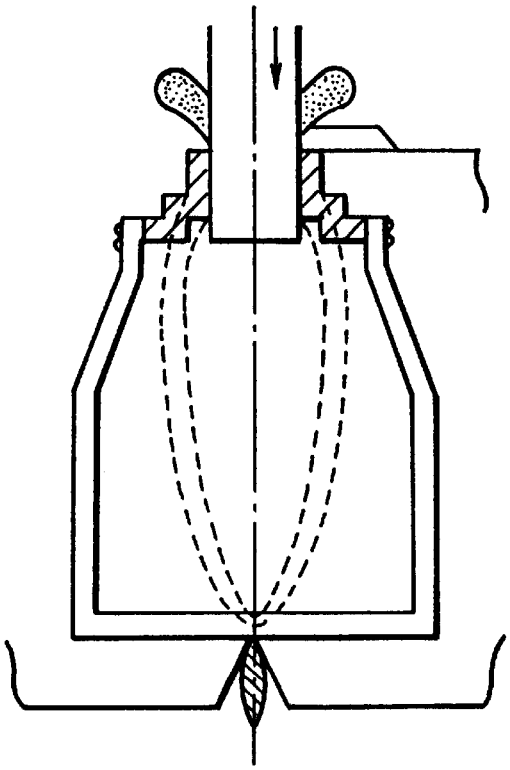

FIG. 12(*a*) through 12 (*b*) schematically show a toner bottle manufacturing process in the comparison example. The process is a so-called direct blowing method including parison step and a blowing step. A substantially cylindrical parison is pushed out, it is sandwiched by metal molds while the parison is still soft. compressed air is injected into the parison to expand it, thus transferring it to the metal mold, thus manufacturing the bottle. In this case, the bottle and mouth portion has a projected parison, which has to be removed. Particularly in the mouth portion, the accuracy is required to satisfy the angular position of the lever. Therefore, it was necessary to effect a finishing process after cutting of the parison.

With this manufacturing method, the thickness is not controllable at the projection and screw portion adjacent the opening with the result of recesses and projections in the inside as shown in FIG. 11. Therefore, after the toner is discharged, the toner stagnates in the recess, and therefore, the remaining amount of the toner increases. Toner bridging tends to occur because of the recess.

The evaluations of the comparison example will be described.

Since the thicknesses are large, the observation is not easy, and therefore, it is difficult to observe the motion of the toner in the bottle during the toner discharging. The toner loosening effect is better in the comparison example since it has only perpendicular ribs. Because of this, the toner powder contains sufficient amount of air, and therefore, the flowability is good so that all of the toner can be discharged in approx. 20 sec.

The inside surface adjacent the opening of the toner bottle is not smooth as shown in FIG. 11, and therefore, the amount of the remaining toner after the completion of the discharging was 5–10 g. When the toner bottle is not sufficiently shaken before the start of the discharge, toner bridging (plugging) sometimes occurred, the bridging being started from the recess or projection in the inside surface adjacent the opening of the bottle.

During toner supply, when the shutter is open, the bottle was strongly pressed by hands. The thickness of the bottle is large in the comparison example, and therefore, it exhibited sufficient rigidity, and therefore, no large deformation occurs. The toner did not blow out.

When the thickness of the bottle was the same as that of the embodiment, the rigidity is not sufficiently only by the perpendicular ribs, and it deformed significantly when the bottle is pressed strongly by hands, with the result that the toner blew out.

The toner bottle of the comparison example was subjected to the same falling test, reducing pressure test, high temperature and high humidity test. The inconveniences such as toner bottle breaking, toner leakage, cap loosening or the like did not occur.

In the case of the bottle having a smaller diameter with all the other structure the same as in the comparison example, there was no problem in the reduced pressure test and the high temperature and high humidity test. However, in the falling test, the toner bottle broke, and the toner leaked.

Another Embodiment

FIGS. 3(B and 3(*c*) show cross-sectional configuration of the rib according to another embodiment. The configuration of the rib is not limited to FIG. 3(*a*) configuration. It may be a combination of a straight line and an arcuated line, as shown in FIG. 3(*b*), or V-shaped, as shown in FIG. 3(*c*). More particularly, in FIG. 3(*b*), when the width w is 8.2 mm, and the depth d=3.5 mm, the depth d' of the straight line portion is preferably approx. 1.0 mm. In the case of FIG. 3(*c*) the same advantageous effects as in FIG. 3(*a*) can be provided if the width w is 8.2 mm approx. and the depth d is 3.5 mm approx.

The cap is not limited to a rotary shutter, and may be a sliding type shutter in which the entirety of the opening is opened.

In the foregoing example, the material of the bottle was polypropylene resin, but other plastic materials are usable. Among them, polyester resin is particularly preferable.

When the polyester resin is used, it is preferable that the height of the bottle is not less than 2.0 times and not more than 3.0 times the height of the preform, this is because the polyester resin material exhibits high self curing property, and can be expanded more than the polypropylene material. On the contrary, a sufficient anti-impact property is not provided if the expansion is less than two times.

The embodiments of the present invention provides the following advantageous effects:

(1) The thickness of the toner bottle can be relatively small, and therefore, the amount of the plastic material used can be saved (source reduction).

(2) The cost can be reduced because of the advantage (1), and the manufacturing cost of the toner bottle can be further reduced because parison trimming opening end surface finishing operation is not required according to injection/stretching/blowing method.

(3) The rigidity of the toner bottle can be increased, and therefore, toner blowing can be prevented even if the toner bottle is pressed strongly during the toner supplying operation.

(4) The transparency of the toner bottle can be increased by the advantage (1), and therefore, the toner in the bottle can be observed during the toner supplying operation.

(5) The accuracy of the screws in the toner bottle opening can be improved, thus preventing the toner leakage from between the cap and the bottom body.

(6) The accuracy of the screw at the toner bottle opening is improved, and the positional accuracy of the angular position of the cap is improved.

While the invention has been described with reference to the structures disclosed herein, it is not confined to the details set forth and this application is intended to cover such modifications or changes as may come within the purposes of the improvements or the scope of the following claims.

What is claimed is:

1. A manufacturing method for a toner bottle, comprising the steps of:

injection molding a preform having an opening;

expanding the preform by a stretching rod;

blowing the expanded preform to form a bottle;

supplying powdery toner into said bottle; and mounting a cap to close an opening of the bottle.

2. A method according to claim 1, wherein said bottle is of polypropylene resin material, and a height of said bottle is not less than 1.2 times and not more than 2.5 times the height of the preform.

3. A method according to claim 1, wherein said bottle is of polyester resin material, and a height of said bottle is not less than 2.0 times and not more than 3.0 times the height of the preform.

4. A method according to claim 1, wherein said bottle has a screw-like projection adjacent to the opening, and a bottle inner surface corresponding to a screw portion is smooth.

5. A method according to claim 1, wherein said bottle has a projection adjacent to the opening is in the form of a screw for mounting the cap.

6. A method according to claim 1, wherein a mold for determining a shape of the bottle is used in the blowing step.

7. A method according to claim 6, wherein a rib is formed on the bottle during the blowing step by the mold.

* * * * *

UNITED STATES PATENT AND TRADEMARK OFFICE

CERTIFICATE OF CORRECTION

PATENT NO. : 5,848,516

DATED : December 15, 1998

INVENTOR(S) : YUTAKA BAN

It is certified that error appears in the above-identified patent and that said Letters Patent is hereby corrected as shown below:

COLUMN 1,
Line 22, "female," should read --female--.

COLUMN 3,
Line 38, "are a" should read --are--;
Line 40, "are a" should read --are--;
Line 43, "is" should read --is a--; and
Line 60, "to 12(b) are a" should read --and 12(b) are--.

COLUMN 4,
Line 6, "groove" should read --grooves--;
Line 7, "is a" should read --is--; and
Line 14, "(recess)" should read --(recesses)--.

COLUMN 5,
Line 2, "as shown in Fig. 3(d)" should be deleted; and
Line 3, "rib" should read --ribs--.

COLUMN 7,
Line 19, "is" should read --are--.

COLUMN 8,
Line 3, "is" should read --are--;
Line 25, "portion the" should read --portion of the--; and
Line 63, "of" should be deleted, and "shaked" should read --shaken--.

UNITED STATES PATENT AND TRADEMARK OFFICE

CERTIFICATE OF CORRECTION

PATENT NO. : 5,848,516

DATED : December 15, 1998

INVENTOR(S) : YUTAKA BAN

It is certified that error appears in the above-identified patent and that said Letters Patent is hereby corrected as shown below:

COLUMN 9,
Line 5, "than" should read --more than--;
Line 24, "By the" should read --By--;
Line 34, "does not occur." should read --occurs--;
Line 45, "have" should read --has--;
Line 55, "was" should read --were--;
Line 57, "in conveniences" should read --inconveniences--; and
Line 66, "test" should read --tests--.

COLUMN 10,
Line 20, "compressed" should read --Compressed--;
Line 23, "has" (1st occurrence) should read --have--;
Line 59, "sufficiently" should read --sufficient except--; and
Line 60, "it" should read --it was--.

COLUMN 11,
Line 7, "FIGS. 3(B" should read --FIGS. 3(b)--.

Signed and Sealed this

Twenty-first Day of December, 1999

*Attest:*

Q. TODD DICKINSON

*Attesting Officer*

*Acting Commissioner of Patents and Trademarks*